United States Patent [19]

Castelli

[11] 4,227,692

[45] Oct. 14, 1980

[54] DUAL GAME BALL PADDLE

[76] Inventor: Bertrand Castelli, c/o Myron Salisian, Esquire, 251 S. Lake Ave., Suite 701, Pasadena, Calif. 91101

[21] Appl. No.: 958,059

[22] Filed: Nov. 6, 1978

Related U.S. Application Data

[63] Continuation-in-part of Ser. No. 948,658, Oct. 5, 1978.

[51] Int. Cl.[3] ..... A63B 59/00

[52] U.S. Cl. ..... 273/67 R

[58] Field of Search ..... 2 73/67 R, 76, 73 R; 272/122

[56] References Cited

U.S. PATENT DOCUMENTS

| | | | |
|---|---|---|---|
| D. 240,055 | 5/1976 | Spivey | D34/5 SP |
| 793,101 | 6/1905 | Schmidt | 272/122 |
| 1,930,281 | 10/1933 | Ogden | 273/67 R |
| 3,879,250 | 4/1975 | Rankin, Jr. | 273/67 R |
| 4,062,541 | 12/1977 | Marks | 273/67 R |

*Primary Examiner*—John D. Yasko

*Attorney, Agent, or Firm*—Wm. Jacquet Gribble

[57] ABSTRACT

Two paddle striking surfaces or panels are spaced an interval sufficient to receive a player's hand between the panels. The panels which define striking surfaces are similar in configuration one to another. Separable central posts secure the paddle panels in spaced relationship and afford a grip whereby the paddle striking surfaces may be grasped and manipulated by a player's hand. The surfaces mask the greater part, or all, of the palm and back of the hand. The striking panels may be integrally formed or may be selectively separable elements. preferably the attitude of the striking panels with respect to one another is such that they are substantially parallel when the paddle is in use on the player's hand. Various straps may be used on the paddles to afford a secondary link between the player's hand and the striking panels, such that the movement of the hand results in immediate like movement of the two panels without changing the panel relationship one to another, when used together.

4 Claims, 9 Drawing Figures

FIG. 1.
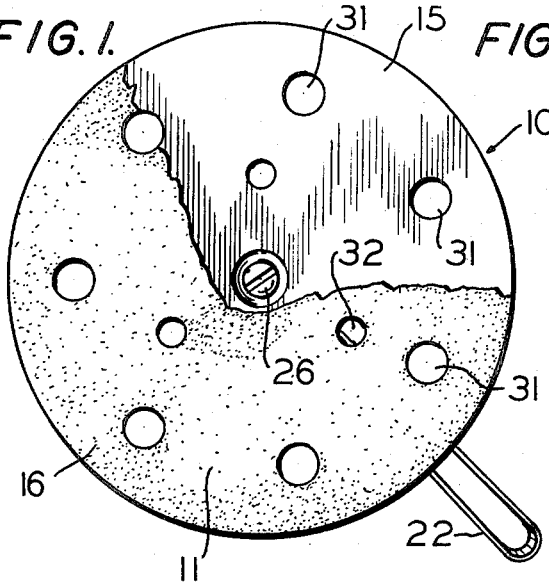
FIG. 2.
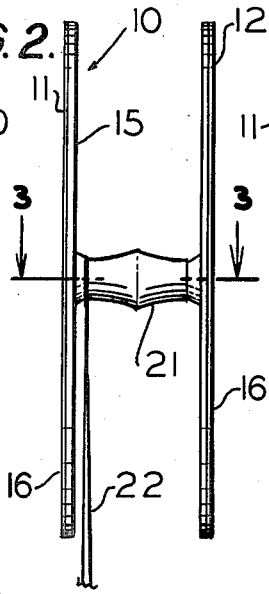
FIG. 3.
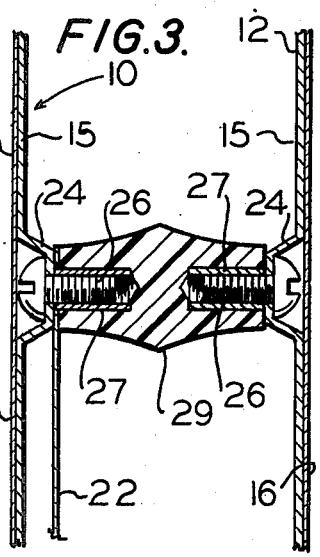
FIG. 4.
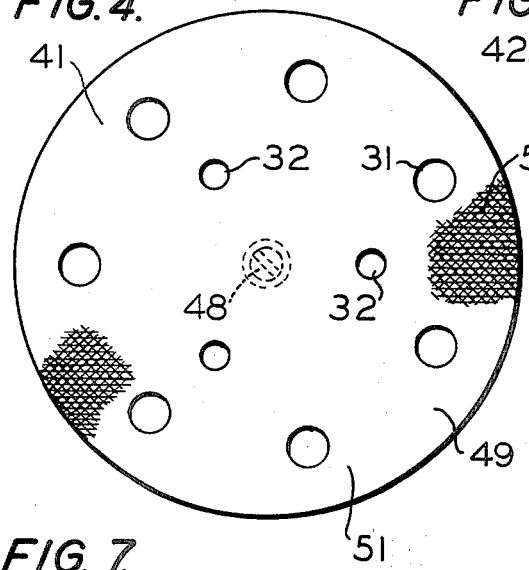
FIG. 5.
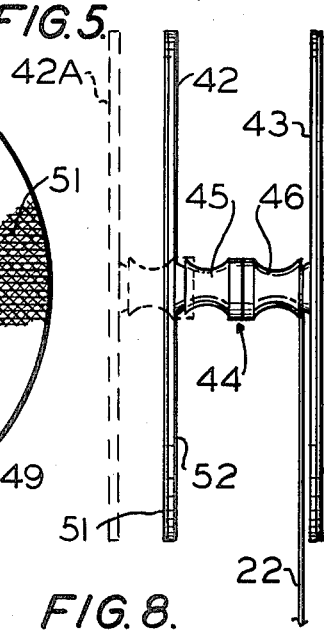
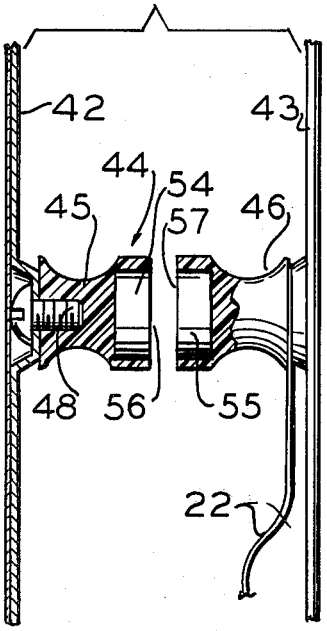
FIG. 6.
FIG. 7.
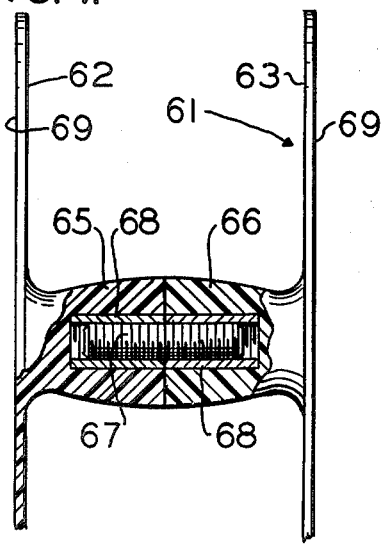
FIG. 8.
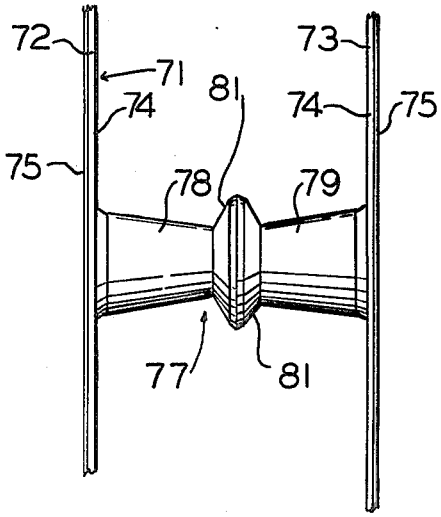
FIG. 9.
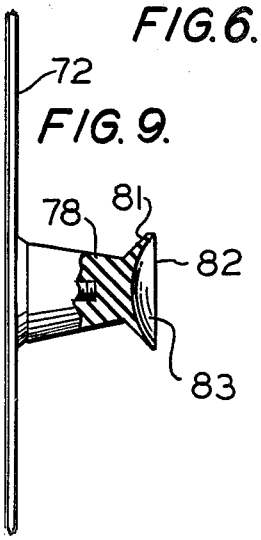

DUAL GAME BALL PADDLE

RELATED APPLICATIONS

This application is a continuation-in-part of co-pending application Ser. No. 948,658, filed Oct. 5, 1978 and entitled "Game Ball Paddle".

BACKGROUND OF THE INVENTION

The invention relates to ball games in which a ball or other game projectile is struck by a paddle or racquet to direct the ball or projectile over or to a playing surface. Such games as tennis, racquet ball, badminton, handball, ping-pong and table tennis are exemplary of the games with which the inventive paddle is concerned.

An object of the invention is to provide superior striking control not necessarily dependent upon the training and experience of a player in a court or table game but based upon natural dexterity, so as to increase the enjoyment of, and the number who may enjoy, table games. In games like ping-pong and table tennis, for instance, where rigid protocol has developed regarding size and the nature of the playing surface, small players and players with small living quarters have been all but precluded from enjoying the games. The inventive paddle has been developed in conjunction with playing surfaces for ping pong and table tennis which are of less than regulation size and height and with projectiles of varied rebound qualities to provide a game suited to the enjoyment of more players while adding to the excitement of the games.

In order to provide the needed dexterity and faster response time for players with lesser experience or great experience the invention provides paired or separable striking panels which are, in essence grasped by a player's hand or hands to cover either or both of the front and the back thereof during play so that forehand and backhand strokes may be made without the cumbersome intervening mechanical linkage of a conventional paddle or racquet handle.

SUMMARY OF THE INVENTION

The invention contemplates a projectile striking paddle for a game in which a projectile is struck by a player which may comprise an obverse striking panel and a reverse striking panel with each of the panels having an outer, substantially planar striking surface. Each panel further is spaced from the other panel when paired an interval sufficient to accept a player's hand between the panels. Connecting posts on the striking panels afford means for securing the panels by a player's hand. Such means may also fix the relationship between the two spaced striking panels. Auxiliary loops may afford flexible ties to a player's hand. A preferred embodiment includes air apertures in the panels opening through the striking surface thereof.

One embodiment of the invention may comprise separable striking panels of circular configuration connected by a rigid post, with the post being split to make separable the spaced striking panels on opposite sides of the player's palm, so that one panel may optionally be used in each hand. In another embodiment the post is solid but the panels are removalbe therefrom.

The invention provides a projectile or ball striking paddle which imparts control to the striking of a game ball or projectile of a degree not conventionally possible with an extended handle on a conventional paddle or racquet without having great practice and experience. Most players have sufficient natural dexterity of arm and hand to impart all of the strokes needed in court and table games when the paddle of the invention becomes a part of the hand. In fact, court coverage not possible with conventional paddles and racquets with extending handles may be achieved with the paddle of the invention when its separable parts are used one in each hand.

The apparatus of the invention is easily fabricated from present materials at low cost. The mode of use is instantly comprehended and adds to the enjoyment of court and table games by big and small, experienced and inexperienced. These and other advantages of the invention are apparent from the following detailed description and drawing.

BRIEF DESCRIPTION OF THE DRAWING

FIG. 1 is a front elevational view of a ball striking paddle in accordance with the invention, partly broken away;

FIG. 2 is an elevational side view thereof;

FIG. 3 is a sectional plan view taken along line 3—3 of FIG. 2;

FIG. 4 is a front elevational view of an alternate embodiment of the invention with separate striking panels;

FIG. 5 is a side elevational view of the embodiment of FIG. 4 having separable striking panels;

FIG. 6 is a side elevational view, partly in section, of the embodiment of FIG. 4, shown in separated condition;

FIG. 7 is a side elevational view, partly in section, of a still further alternate embodiment of the invention;

FIG. 8 is a side elevational view of a still further alternate embodiment of the invention; and FIG. 9 is a side elevational view of one of the separated striking panels of the paddle of FIG. 8, partly in section.

In the various figures like numbers have been used to identify like parts.

DESCRIPTION OF THE PREFERRED EMBODIMENTS

FIGS. 1, 2 and 3 illustrate an embodiment of the invention wherein a paddle 10 is comprised of an obverse striking panel 11 and a reverse striking panel 12. The panels are similar in configuration, although the invention does not preclude a larger striking panel for the forehand or backhand surface, as the player finds helpful. Each panel comprises a base plate 15 (FIG. 1) and a striking surface disc 16, which may have a grit exterior such as the ping pong and table tennis paddles of conventional design. The parallel striking panels are separated by a central post 21 to which each striking panel 11, 12 is separably secured. A tie loop 22 may be anchored between an end of the central post and an inward boss 24 of the base plate. Each striking plate is held in the end of the central post by a threaded member 26, extending from the boss as best seen in FIG. 3.

The central post may be cast of moldable material such as plastic, rubber or base metal and contain internally threaded bushings such as bushing 27 to receive a threaded member 26 by means of which each base plate with its friction surface 16 is secured to the central post.

The fit between the bushings and threaded members should be of a thread tolerance class such that striking panels may be manually disengaged from the central post by rotating the panels about the axis of the post to disengage the threaded member from the bushing.

The central post in embodiment of FIG. 1 is contoured such that it has a peripheral ridge 29 which may be equidistant from the inner surfaces of both striking panels. The ridge affords additional grasping facility for finers of the player as he places his hand between the striking panels wih the fingers about the central post.

It has been found that a striking panel approximately 17 centimeters in diameter is optimum for an adult player. The distance between striking panels should be about 5 centimeters for accommodation to the hand thickness of an adult player. For junior players and small children the dimensions may be diminished without departing from the spirit of the invention.

Inspection of FIG. 1 shows a plurality of air apertures through the panels, such as the outer circle of apertures 31 and an inner circle of apertures 32. In an illustrative embodiment there are seven apertures 31 and three apertures 32. Preferably the outer apertures, being in the area less frequently in contact with the game projectile are of slightly larger diameter, preferably 12 millimeters or less. The apertures of the inner circle are preferably of 8 centimeters or less in diameter. These apertures are distributed such that there is considerable area of the striking surface which is planar, the inner apertures being small enough in diameter that they do not interfere with the striking and the resulting projectory of projectiles, such as ping pong balls being returned against the opposite player.

The tie loop 22 may be elastic or flexible and is passed over the hand and wrist of a player before the player inserts his hand between the striking panel to grasp the central post. The tie loop is precautionary, permitting some relaxation of the hand grip on the central post without the danger of losing control of the dual paddle of the invention.

The panel bosses 24 recess the head of the threaded member 26 such that striking surface 16 of each of the striking panels 11, 12 is substantially planar throughout its surface except for the air apertures 31 and 32. It should be noted that the air apertures extend through both striking surface 16 and base plate 15 such that the air may circulate between the two striking panels. In some measure this provides for a faster stroke since the air drag of the rapidly moving paddle is reduced. It also adds to player comfort since the air circulation has a cooling effect on the player's hand, which is encompassed by the striking panels.

The extreme versatility of the dual paddle of the invention is such that either one or the surfaces may be presented by a slight turn of the hand, adding greatly to the enjoyment of the game. However, the striking panels are separable one from the other such that a player may, if desired, play with a single striking panel grasped by the central post, in either one or two hands.

A dual ball paddle 41 in accordance with the invention is illustrated in FIGS. 4 through 6. Whereas the paddle of the embodiment of FIG. 1 is separable by unscrewing a striking panel the paddle of the embodiment of FIG. 4 affords separation by a partition of the central post. In this embodiment dual paddle 41 has an obverse striking panel 42 and a reverse panel 43. A central post 44 has an obverse post portion 45 and a reverse post portion 46. Each of the striking panels is secured to a post portion by a threaded member such as the member 48 shown in FIG. 6 joining panel 42 to obverse post portion 45. Each of the striking panels, like the previously described panels has a plurality of outer air apertures 31 and smaller inner air apertures 32. The striking panels 42, 43 each have a friction striking disc 49 which may have a molded screen pattern 51, such as is shown in FIG. 4, defining the friction surface of the laminar striking disc 49 adhered to or otherwise fixed to a base plate 52 of each of the striking panels, 42, 43 of the embodiment of FIG. 3.

In FIG. 6 the central post 44 is shown separated into its obverse and reverse post components. Each of the post portion inner ends contains a magnet 54, 55. The magnets are oriented within the posts so that their abutting surfaces 56, 57 respectively are of opposite polarity. Thus central post 44 is magnetically secured into one element when the magnets are joined, holding the striking panels 42, 43 in substantially parallel position oriented about the central axis about the posts. As in the previous embodiment a tie loop 22 may be employed to further secure the dual paddle of FIG. 4 to a player's hand.

An alternate embodiment is illustrated in FIG. 7 wherein a dual ball paddle 61 has striking panels 62,63 which are secured to separable central post elements 65, 66 respectively, by a threaded member 67. Each of the post portions 65, 66 is molded about an internally threaded bushing 68 which receives the joining threaded member 67. Additionally, each striking panel 62, 63 is integrally molded with the adjacent central post portion such that the mode of separating the parallel joined striking panels is by means of disengagement threaded member 67 from one or the other of the internally threaded bushings 68 of the central post portions. The friction surface of the striking faces 69 of each of the striking panels may be molded or impressed into the surfce of the striking panel at the time the piece is fabricated.

In the embodiments of FIGS. 8 and 9, a dual paddle 71 comprises spaced striking panels 72, 73 each with a base plate 74 and a striking disc 75 which may have a high friction surface as in the previously described embodiments. A central post 77 is comprised of an obverse post portion 78 and a reverse post portion 79 which are conveniently secured to their adjacent striking panels in either of the manners previously described. Each post portion terminates internally in an enlarged vacuum cup portion 81 which is shown in section in FIG. 9.

In FIG. 9 obverse striking panel 72 is shown separated from reverse striking panel 73. As can be seen from that Figure, the obverse post 78 terminates in enlarged head 81 whose transverse face 82 is concave to define a cup 83. The post portion 78 is preferably made of resilient deformable material such as neoprene rubber, rubber or a comparable plastic such that the heads may be deformed from the concave condition shown in FIG. 9 to the substantially planar condition obvious in FIG. 8 when the two central post portions are pressed together axially of the post to exhaust the air entrained in the cups when they are placed together and therefore form a vacuum seal between the post portions to secure the striking panels in their spaced, substantially parallel relationship. When joined the post portions afford a gripping post for the player and are substantially fixed one with respect to the other so that the dual paddle may be employed in the game for which the particular paddle is employed.

The embodiments of FIGS. 7 and 8 may have striking panels with air apertures as in the previously described embodiments for the same purposes. In all of the embodiments a player is afforded a versatile instrument for the strokes of the particular game. While the paddles have been described in conjunction with table tennis or ping pong, paddles in accordance with the invention, of suitable dimensions and materials, may be employed in many of the racquet and paddle games now conventional.

It is obvious from the foregoing description that the inventive dual paddle may be inexpensively fabricated by present day fabricating techniques at low cost. It is also obvious that modifications within the scope of the invention other than those illustrative embodiments disclosed above may occur to those skilled in this particular art. It is therefore desired that the invention be measured by the appended claims rather than by the foregoing illustrative description.

I claim:

1. A projectile striking paddle for a game in which a projectile is struck by a player and comprising an obverse striking panel, a reverse striking panel, each of said panels having an outer, substantially planar striking surface; a post joining said striking panels such that each panel is spaced from the other striking panel an interval sufficient to accept a player's hand turned palm toward a panel between said striking panels, said post having an obverse post and a reverse post, means engaging each of said striking panels with said post, and separable means securing said obverse and reverse posts together such that said panels are substantially parallel, said separable means defining means for selectively disconnecting one of said striking panels from the other of said striking panels.

2. A paddle in accordance with claim 1 wherein said separable means securing the obverse and reverse posts together comprises internal threads in each of the obverse and reverse posts, and an externally threaded member adapted to threadedly engage both of said internal threads in said obverse and reverse posts.

3. A paddle in accordance with claim 1 wherein said separable means securing the obverse and reverse posts together comprises a magnet in an end of each post remote from its attachment to said striking panel, the magnets in each post being oppositely oriented to present attracting poles when the obverse and reverse posts are butted together.

4. A paddle in accordance with claim 1 wherein said separable means securing the obverse and reverse posts together comprises a vacuum suction cup on the end of each of the obverse and reverse posts remote from the striking panel.

* * * * *